US007281890B2

(12) United States Patent
Friesen et al.

(10) Patent No.: US 7,281,890 B2
(45) Date of Patent: Oct. 16, 2007

(54) ARRANGEMENT FOR THE ATTACHMENT OR DETACHMENT OF AN ASSEMBLY TO A BASE STRUCTURE

(75) Inventors: Henry Friesen, Niagara Falls (CA); Radu Traian Guja, Welland (CA)

(73) Assignee: Deere & Company, Moline, IL (US)

( * ) Notice: Subject to any disclaimer, the term of this patent is extended or adjusted under 35 U.S.C. 154(b) by 160 days.

(21) Appl. No.: 10/840,982

(22) Filed: May 7, 2004

(65) Prior Publication Data

US 2005/0281659 A1 Dec. 22, 2005

(51) Int. Cl.
*E02F 3/627* (2006.01)

(52) U.S. Cl. ..... 414/686; 172/275

(58) Field of Classification Search ..... 414/686; 172/272, 273, 274, 275; 29/700
See application file for complete search history.

(56) References Cited

U.S. PATENT DOCUMENTS 5,387,076 A 2/1995 Fuzzen ..... 414/686
5,388,950 A 2/1995 Schmahl et al. ..... 414/686
5,895,199 A 4/1999 Baumert, III et al.

FOREIGN PATENT DOCUMENTS

| | | |
|---|---|---|
| DE | 35 21 240 | 12/1986 |
| GB | 2 281 278 | 3/1995 |
| JP | 04 110406 | 9/1992 |
| JP | 05 009951 | 1/1993 |

OTHER PUBLICATIONS

John Deere Brochure. 2 pages date not shown.

*Primary Examiner*—Donald Underwood

(57) ABSTRACT

An arrangement for the attachment or detachment of a loader assembly or similar implement from a tractor includes a first member adapted to be received by a tractor, a second member adjustably connected to the first member, the second member adapted to receive the implement, and a third member also adapted to be received by the tractor, the third member mounted to the first member for movement between first and second positions relative to the tractor, movement of the third member from its first position into its second position causing transformation of the third member into an upright portion that assists in stabilization of the first and second members and the implement against the ground.

9 Claims, 9 Drawing Sheets

ARRANGEMENT FOR THE ATTACHMENT OR DETACHMENT OF AN ASSEMBLY TO A BASE STRUCTURE

FIELD OF THE INVENTION

The invention relates generally to a loader assembly for a tractor, and more specifically to the attachment or detachment of a loader assembly from a tractor.

BACKGROUND OF THE INVENTION

In the past, loader assemblies for tractors have required the operator to leave the operator's seat to manually operate a latching mechanism used in maintaining attachment of the loader assembly with the tractor frame. The attachment or detachment of the loader assembly required significant time, and the mechanisms used a significantly high number of parts.

A loader assembly is needed that may be more easily and quickly attached or detached from a tractor. A loader attachment or detachment mechanism is needed that uses fewer parts, and may be more readily operated from the driver's seat.

SUMMARY OF THE INVENTION

The present invention provides a loader assembly and mechanism for attachment or detachment of the assembly from a tractor. The operator need not leave the operator's seat of the tractor to attach or detach the loader, except to connect or disconnect hydraulic lines used in powering the hydraulic cylinders. Maintenance and other tasks involving the tractor or the loader assembly may be easily performed without having to spend time on the attachment or detachment of the loader assembly.

The loader assembly enables substantially automatic attachment or detachment from the tractor, uses a minimal number of parts compared to previous assemblies. With the present invention, an operator may be more able to easily and inexpensively control the attachment and removal of the loader assembly from a tractor.

THE DRAWINGS AND THEIR ASSOCIATED DESCRIPTION(S)

FURTHER DESCRIPTION OF THE DRAWINGS

In every instance, whether prior or subsequent to the discussion below, it is to be understood that use of the term "substantially" is intended to encompass any deviation, no matter how large or small, which is pertinent to provided description.

Figure 1:
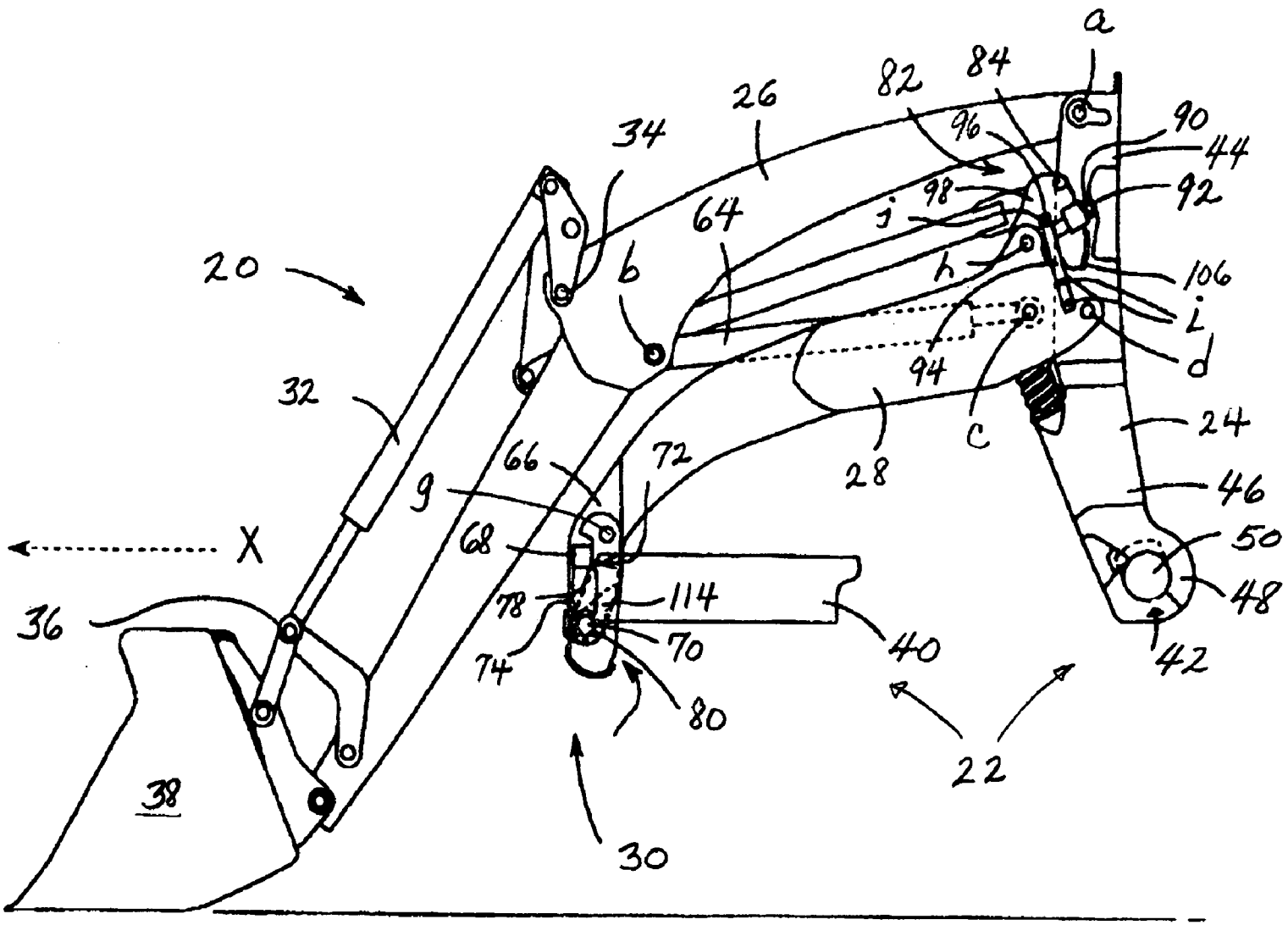
FIG. 1 is a side view of the attachment of a loader assembly to the frame of an agricultural tractor.

Now looking to FIG. 1, there is shown a side view of a loader assembly 20 connected with a base structure such as a frame 22 of an agricultural tractor (not shown). As can be seen, the loader assembly 20 comprises first, second and third operatively connected members, each taking the form of a mast 24, boom 26 and brace 28, respectively. Together, the frame 22 of the tractor and the loader assembly 20 form a mounting arrangement 30.

Throughout FIGS. 1–4, a hydraulic cylinder 32 having various hydraulic connection(s) (not shown) is connected with the boom 26 at one end 34. At a second end 36 thereof, the cylinder 32 associates each of the boom 26 and an implement, such as a bucket 38, so as to allow its desired movement by the operator of the tractor. However, it is further realized and intended that structure other than the bucket 38 may be used in conjunction with the loader assembly 20 being described.

As shown in FIG. 1, the loader assembly 20 is joined to the frame at respective front and rear portions 40 and 42 thereof. Since the loader assembly 20 and frame portions 40, 42 to which it attaches are symmetrical about a longitudinally extending axis "X" of the tractor, only the left side of the front and rear portions 40 and 42 of the frame 22 will be discussed.

Thus, as shown in FIG. 1, it can be seen that the loader assembly 20 is associated with a first mode in which it is fully attached to the frame 22 of the tractor. As shown, the mast 24 of the loader assembly 20 comprises upper and lower ends 44 and 46, respectively. At its lower end 46, the mast 24 is generally openly curled in shape so as to form a catch portion 48 that connects with the rear portion 42 of the frame 22, see FIGS. 1–4.

Figure 8:
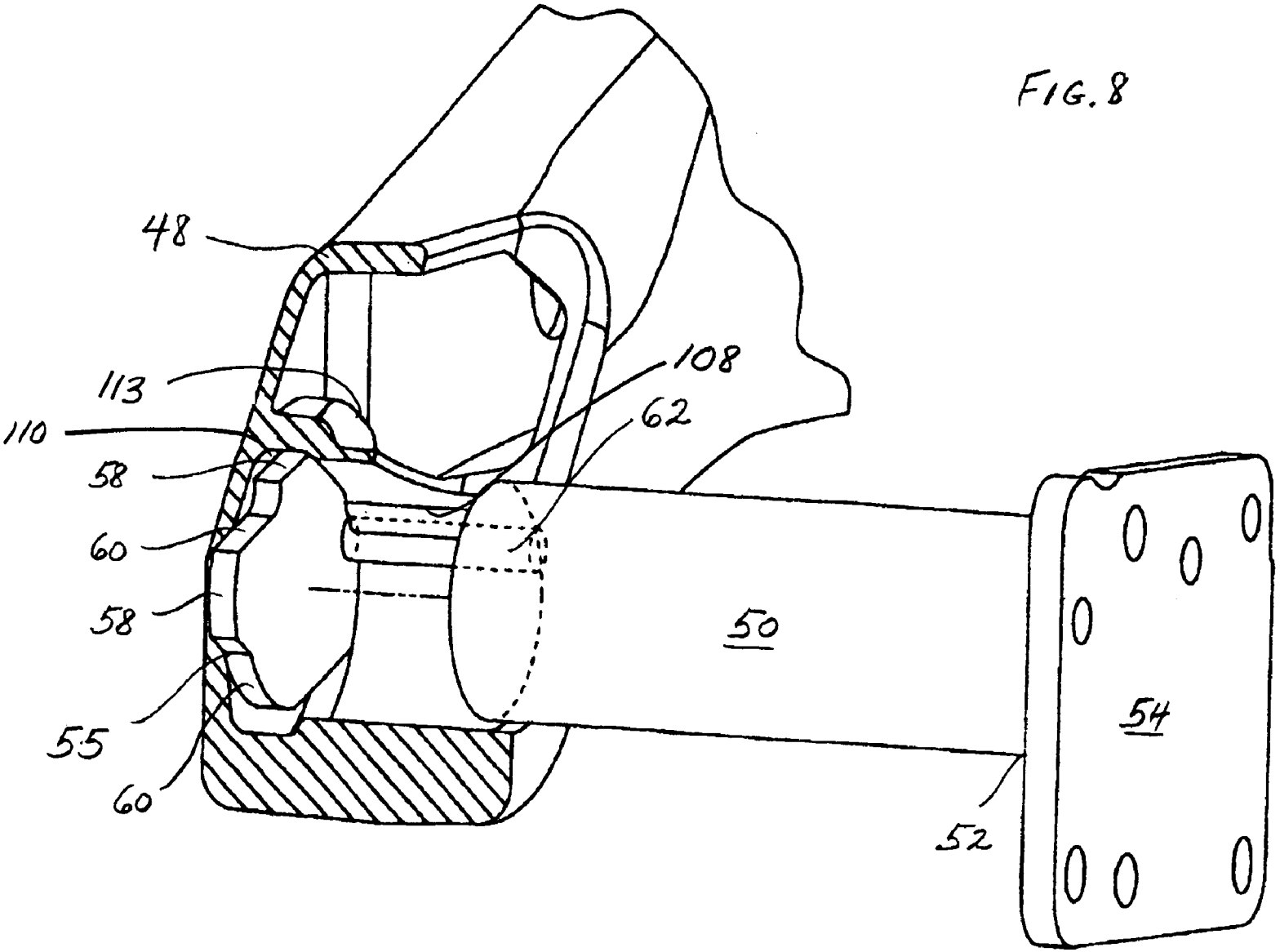
FIG. 8 is a side and perspective cutaway view showing a relation of a portion of a rear portion of the frame of the tractor to loader assembly.

When looking to FIG. 8, the rear portion 42 of the frame 22 is constructed, in part, in the form of a tube 50. At a first end 52 thereof, the tube 50 includes a mounting plate 54 for attachment to the chassis of the tractor. At a second end 55, the tube 50 includes alternating elevated and depressed portions 58,60. Preceding the second end 55, the tube 50 further includes a raised cylinder 62 thereon.

When looking to any of FIGS. 1–4, it to be understood that the upper end 44 of the mast 24 is pivotally attached to, and thus adjustably cooperable with, the boom 26 at point "a". As shown, a boom cylinder 64 (powered via hydraulic connection(s) not shown) links the boom 26 and the brace 28 at points "b" and "c".

The brace 28 is pivotally mounted to the mast 24 at "d" and extends laterally therefrom. The brace 28 includes a ground engaging part, optionally provided as a foot-like member 66. The foot-like member 66 includes at least an upper and a lower spaced contact member 68 and 70, respectively, as is shown in any of FIGS. 1–4 and 7, for connection with the front portion 40 of the frame 22.

The lower contact member 70 is round in cross-section and the upper contact member 68 is square in cross-section. Engagement of the contact members 68 and 70 is made with shelf-like segments 72,74 of the front portion 40 of the frame 22 at points "e" and "f", and against tabs 76 which extend downwardly from the frame.

When looking again to each of FIGS. 1–4 and 7, it can be seen that the lower contact member 70 is formed as part of a hanger 78. The hanger 78 is pivotally mounted to the foot-like member 66 at "g" for allowing its movement with respect to the front portion 40 of the frame 22 during attachment and detachment of the loader assembly 20. Further, the lower contact member 70 has attached to it a pair of laterally opposed and upturned ears 80.

Thus, along with the seating described above, and because the contact members are each parallel and vertically offset from each other, as may be seen in any of FIGS. 1–4 and 7, the brace 28 is able to transmit a beneficial clamping force to the front portion 40 of the frame 22. Consequently, the operator may be generally assured of the loader assembly 20 remaining attached to the tractor even during the most strenuous of work conditions.

As will be understood by one of ordinary skill in the art, the above-described connection of the contact members 68 and 70 with the front portion 40 of the frame 22 substantially eliminates the need for separate latching and stabilization structure necessary to hold the loader assembly 20 in position. Instead, the contact members 68 and 70, themselves, provide for these functions since they simply and securely seat against the front portion 40 of the frame 22. Thus, when compared to previous designs, a less costly and more easily manufacturable loader assembly can be produced.

Figure 5:
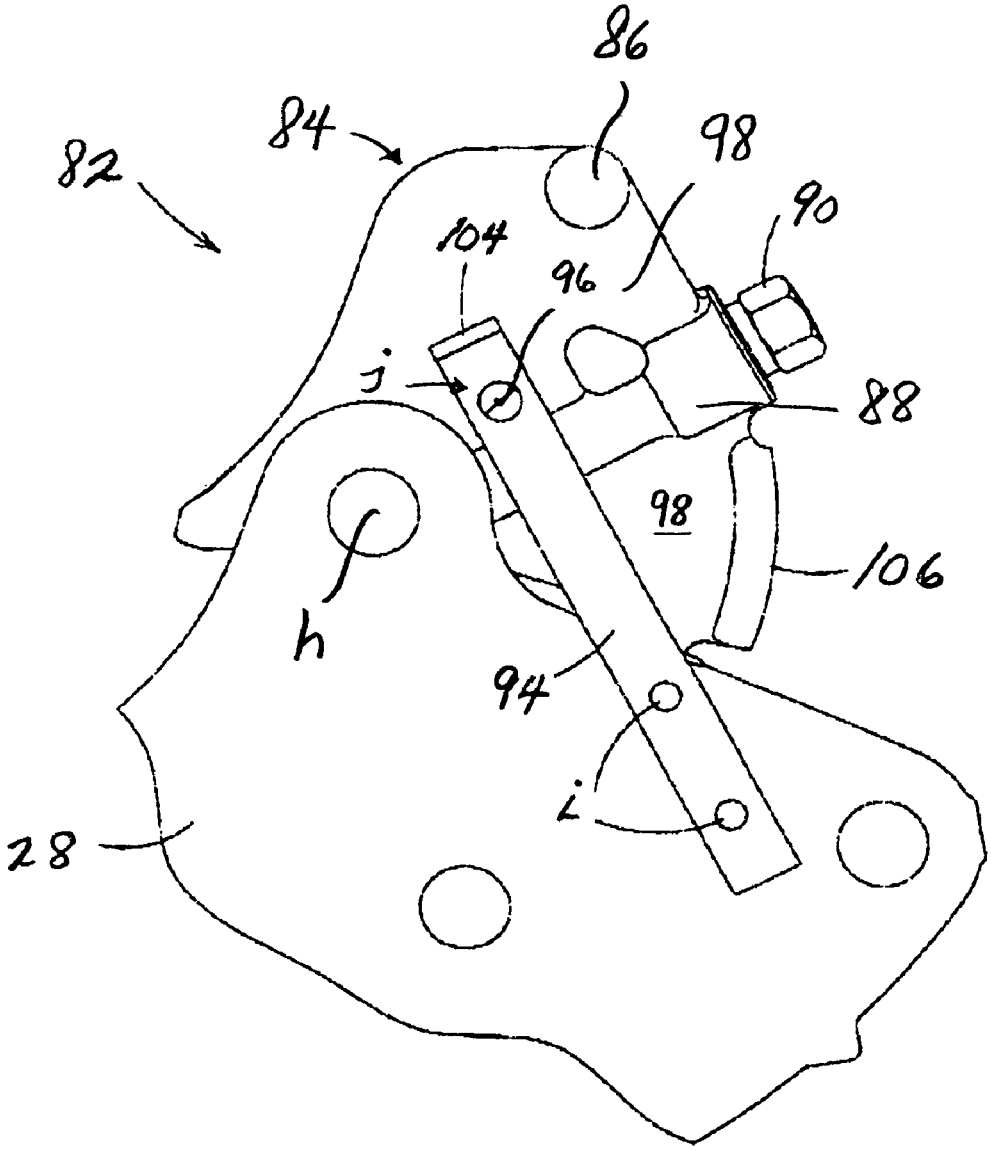
FIG. 5 is an opposite side view of a camming mechanism and its connection to the loader assembly as shown in FIG. 1, and which shows structure used in maintaining positioning of the camming mechanism when attachment or detachment of the loader assembly to the frame of the tractor occurs.
Figure 6:
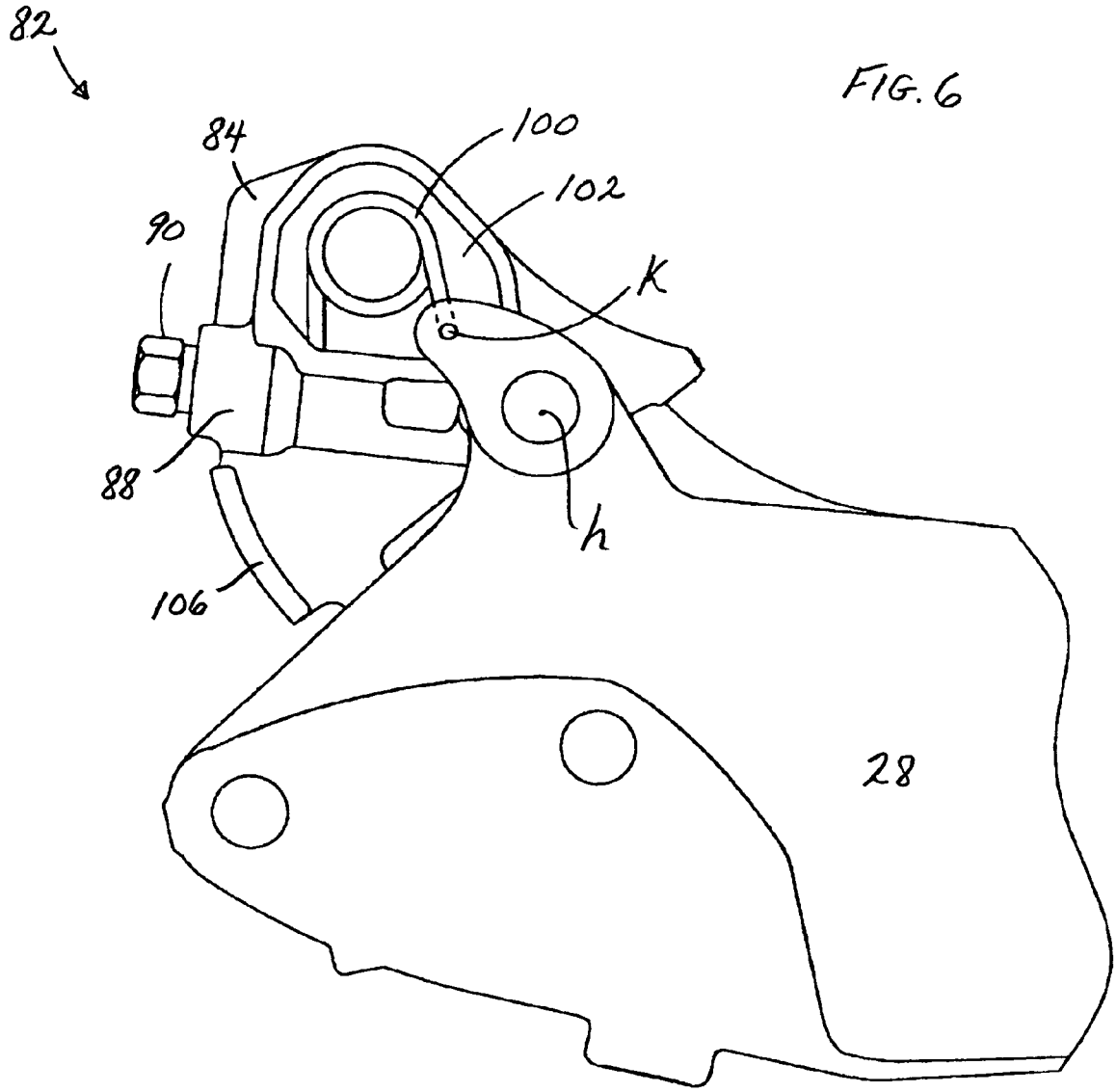
FIG. 6 is a side and perspective view of the camming mechanism and its connection according to FIG. 5, and specifically, wherein the camming mechanism is shown at a point in time when the loader assembly is securedly attached to the frame of the tractor.

As is shown throughout the FIGURES, a camming mechanism 82 is pivotably attached to the brace 28 at "h" for rotation thereabout. The camming mechanism 82 includes a body 84 comprising an actuator which, as may be seen in more detail when looking to FIGS. 5 and 6, is optionally provided as a handle 86 for rotating the body 84 forwardly or rearwardly relative to point "h". Also, the body 84 comprises a housing 88, as seen in FIG. 5, which holds an extensible member such as a bolt 90. The bolt 90 is adjustably positionable with respect to the housing 88 to permit its contact, or non-contact, with an arcuate pad-like surface 92 of the mast 24.

The camming mechanism 82 is shown in association with a latching arm 94, each of which is reachable from the operator's seat of the tractor. The latching arm 94 is optionally provided in the form of a leaf spring. The latching arm 94 is rigidly pinned to the brace 28 at points "i" and adjustably fitted at point "J", as shown in FIGS. 1 and 5, with the body 84 of the camming mechanism 82 via fitting engagement with a lobe 96 extending from a side surface 98 of the body 84.

As seen in FIG. 6, the camming mechanism 82 is further associated with a spring 100. The spring 100 is housed within an interior 102 of the cam body 84 and is connected with the brace 28 at point "k" in order to assist in maintaining its rearward or forward positioning relative to point "h".

Now looking again to FIG. 1, the bolt 90 is shown to be in abutting relationship with the pad-like surface 92 when the handle 86 is rotated rearwardly of point "h". Such relation defines a first mode characteristic of the full attachment of the loader assembly 20 to the frame 22 of the tractor, whereby as already discussed, the mast 24 fits onto the rear portion 42 of the tractor frame 22 and the foot-like member 66 of the brace 28 clamps onto the front portion 40 thereof. In this first mode, an operator may adjustably dial the head of the bolt 90 into substantial engagement with the arcuate pad-like surface 92 of the mast 24. The ability to adjust the bolt length from the housing 88 allows an operator to maintain the placement of the mast 24 relative to the brace 28. Such an ability is beneficial in instances in which wear, whether between the foot-like member 66 and the front portion 40 of the frame 22, the rear portion 42 of the frame 22 and the catch portion 48, or at the engagement of the bolt 90 with the arcuate pad-like surface 92, may tend to loosen the fitting of the loader assembly 20 upon the frame 22.

When looking to FIG. 1, it can be seen that the first operational mode is achieved when (a) the bolt 90 is in substantial contact with the arcuate surface 92 of the mast 24 and (b) the catch portion 48 of the mast 24 is fully seated on the rear 42 of the tractor frame 22. It is intended that the operator maintain the latching arm 94 in the position shown in FIG. 1 in order to maintain the positioning of the body 84 of the camming mechanism 82, and thus, the bolt 90.

Figure 2:
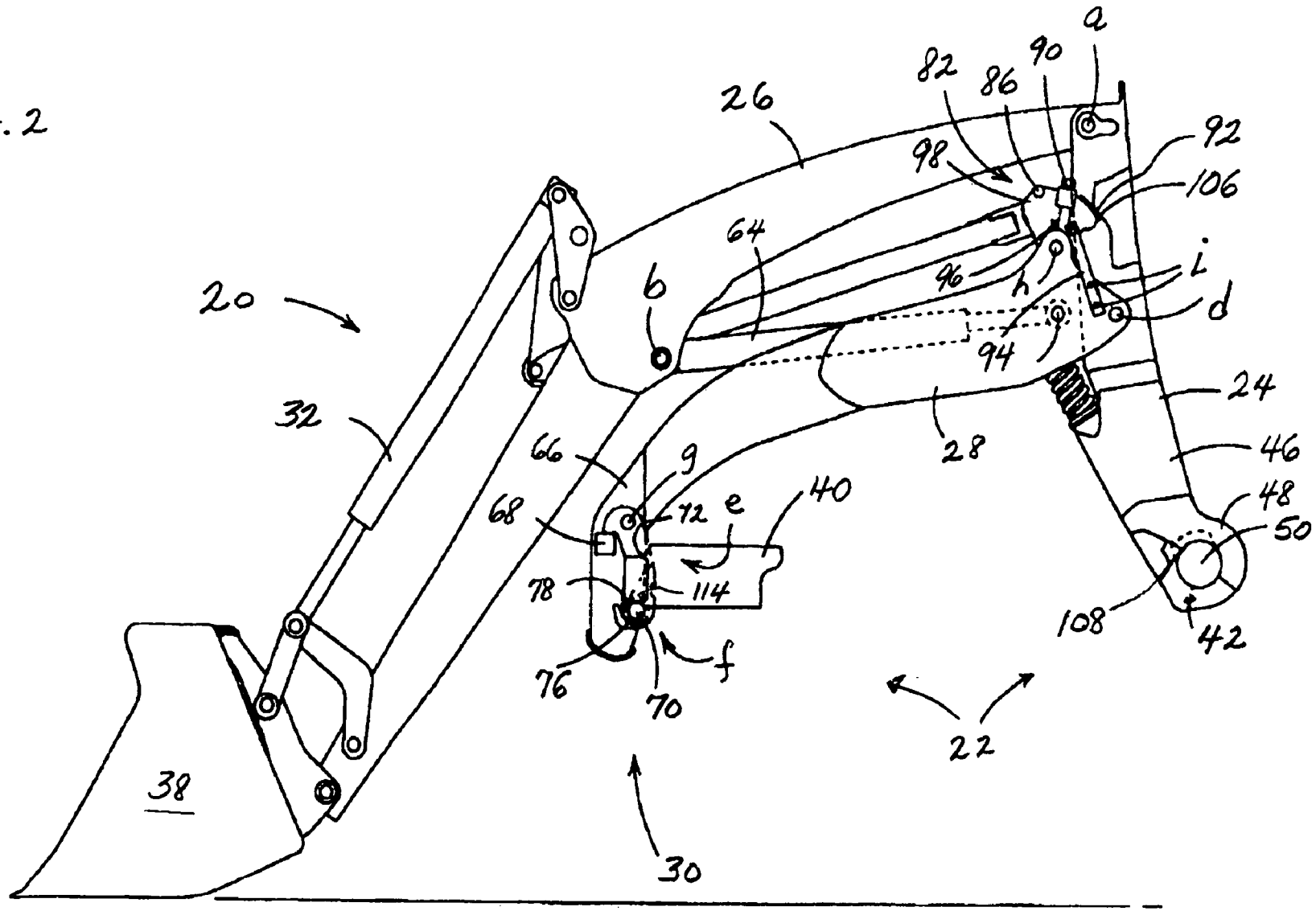
FIG. 2 is a side view of the loader assembly according to FIG. 1 during a first stage of detachment from the frame of the tractor.
Figure 3:
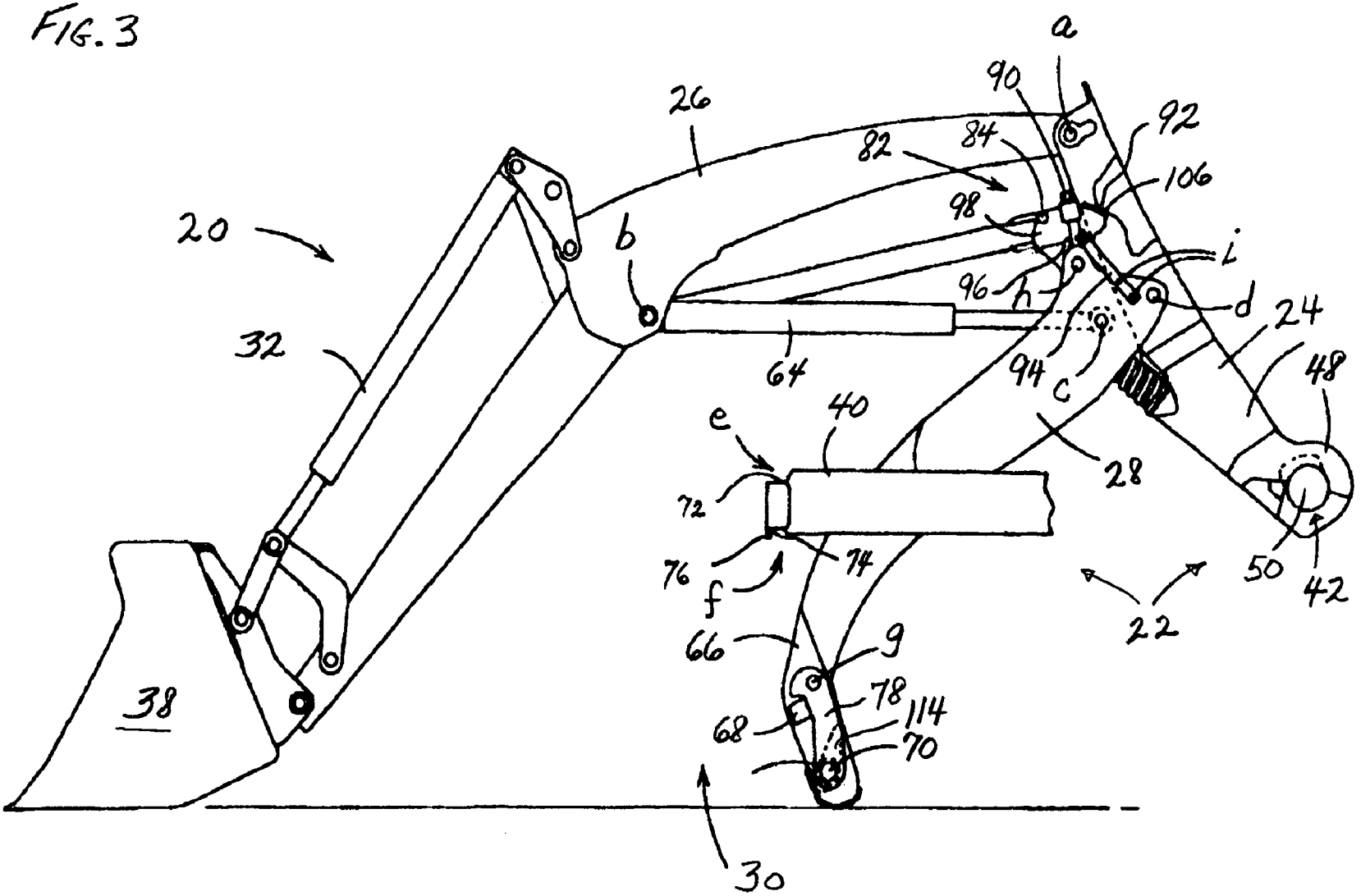
FIG. 3 is a side view of the loader assembly according to FIG. 1 during a second stage.
Figure 4:
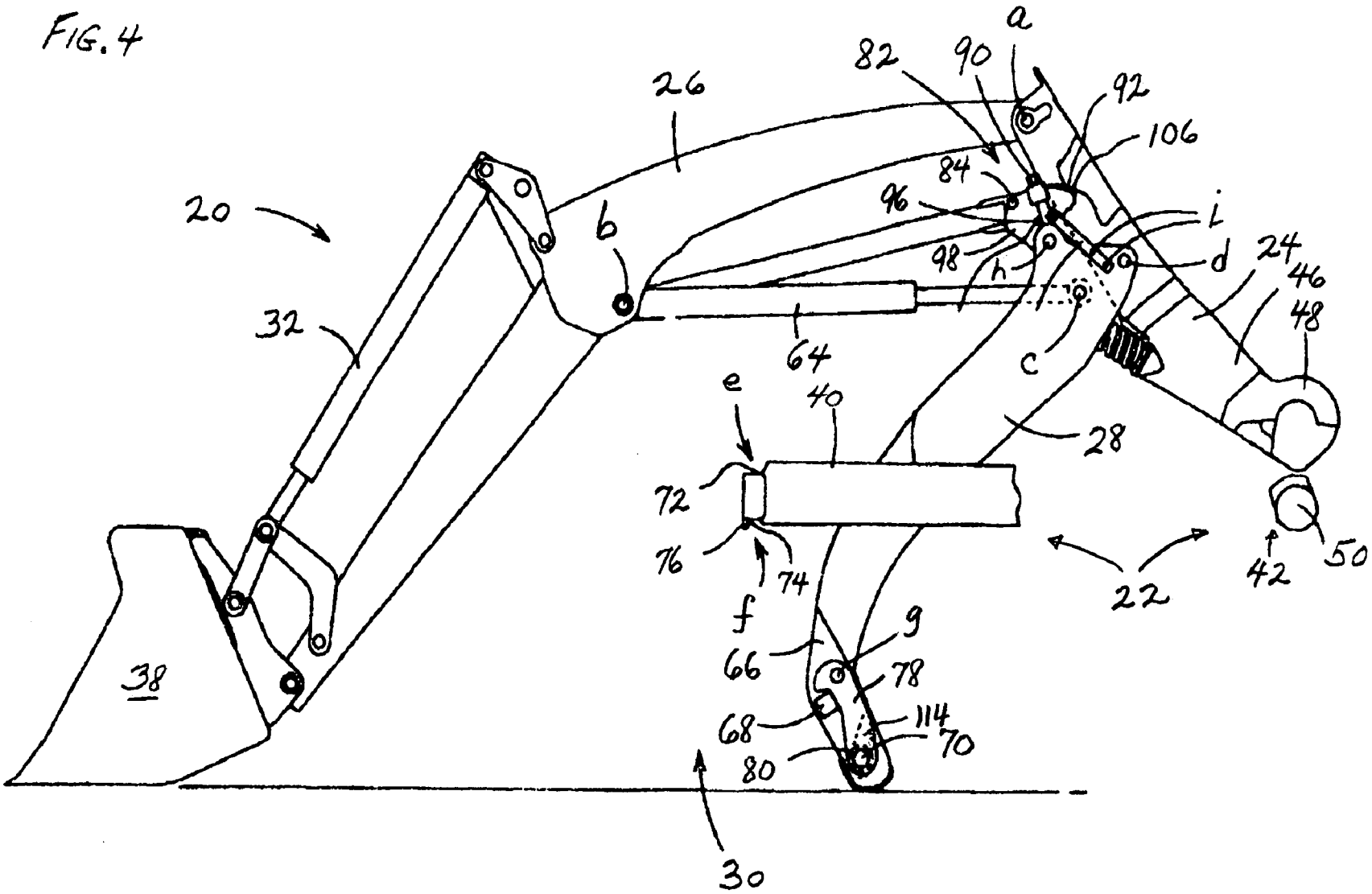
FIG. 4 is a side view of the loader assembly according to FIG. 1 wherein the assembly has accomplished a third or final stage of detachment from the tractor frame.

When looking to any of FIGS. 2–4, it can be seen that a second operational mode is obtained; and which concerns the detachment of the loader assembly 20 from the tractor. Beginning with reference to FIG. 2, a first stage of detachment of the loader assembly 20 begins by disengaging the latching arm 94 by pulling its handle 104 outwardly away from its fitting with the lobe 96. After such disengagement, the handle 86 may then be moved fully forwardly relative to point "h". Such forward movement of the handle 86 rotates the camming mechanism body 84 so as to take the bolt 90 away from its point of contact with the arcuate pad-like surface 92 of the mast 24. As a further result of this forward movement, an end 106 of the body 84 of camming mechanism becomes positioned for abutment with the arcuate pad-like surface 92 of the mast 24.

Such abutment occurs as the first stage of detachment is continued; specifically, as the boom cylinder 64 is initially extended by the operator. Such extension results in a sliding of the bucket 38 along the ground surface. As this occurs, the catch portion 48 of the mast 24 remains substantially seated on the rear portion 42 of the frame 22, but does undergo a slight forward rotation relative thereto. This rotation, as a result of the abutment at and pivotal connection of the brace 26 to the mast 24 at "d", allows the upper contact member 68 of the foot-like member 66 to (a) be moved forwardly, so as to clear the shelf-like segment 72 and (b) then be moved downwardly and in front of the frame portion 40 as a result of the ongoing rotation. As the upper contact member 68 moves downwardly and in front of the frame portion 40, the lower contact member 70 simply separates from its engagement against the frame portion 40 at point "f".

In a second stage of detachment, the boom cylinder 64 undergoes continued extension. During this extension, the body 84 of the camming mechanism 82 remains held against the arcuate pad-like surface 92 of the mast 24. Consequently, the foot-like member 66 is moved toward contact with the ground, as is shown in FIG. 3.

Looking to FIG. 4, a third and final stage of detachment is achieved as the operator causes the boom cylinder 64 to be fully extended. Upon reaching this fullest point of extension, the foot-like member 66 is placed into a substantially perpendicular stance relative to the frame 22 and the ground surface. Substantially simultaneously with this full extension, the catch portion 48 of the mast 24 detaches from the rear portion 42 of the frame 22, as shown more closely in FIG. 9.

Figure 9:
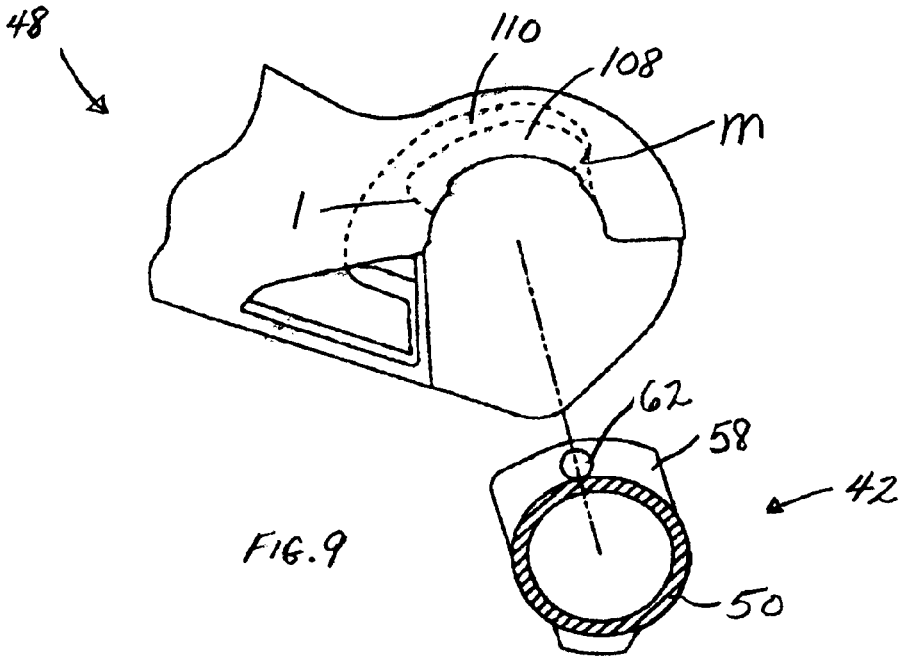
FIG. 9 is a side and cutaway view showing the relation of the frame portion, according to FIG. 8, to the loader assembly when the loader assembly is detached from the frame portion.

In particular, and as shown in FIG. 9, the catch portion 48 of the mast 24 includes a first groove 108 and a second groove 110. The first groove 108 extends from points "1" to "m" and provides a surface against which the raised cylinder 62 makes contact when the mast 24 is attached to the rear portion 42 of the frame 22. Such contact is shown, specifically, at point "1" in FIG. 10.

Figure 11:
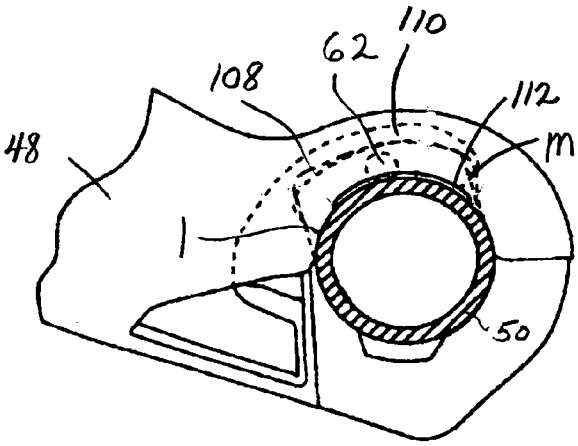
FIG. 11 is a side and cutaway view showing the relation of the frame portion, according to FIG. 8, to the loader assembly when the loader assembly is being detached from the frame portion.
Figure 10:
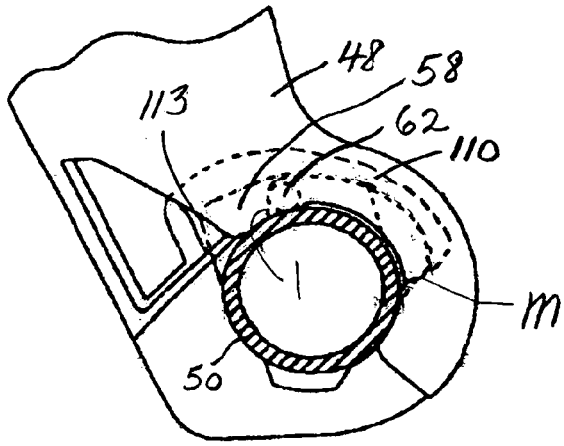
FIG. 10 is a side and cutaway view showing the relation of the frame portion, according to FIG. 8, to the loader assembly when the loader assembly is attached to the frame portion.

In contrast to the positioning of the raised cylinder 62 in FIG. 10, FIG. 11 shows it positioned between points "1" and "m" whereby such positioning occurs while the loader assembly 20 is being detached from the frame 22. Thus, it can be seen that raised cylinder 62 is not in abutment with an end point of the first groove 108. Consequently, the mast 24 is free to move relative to the rear portion 42 of the frame 22.

The second groove 110 provides clearance for the raised portion 58 to move within as the loader assembly is attached or detached from the rear portion of the frame 22. Further, as will be understood by one of ordinary skill in the art, contact between the first groove 108 and the raised cylinder 62 at point "1" is intended to substantially prevent an over-rotation of the mast 24 off of the rear portion 42 of the frame 22. Additionally, such an over-rotation is also prevented since, as shown in FIG. 10, the elevated portion 58 hits against an interior segment 113 of the catch portion 48.

As may now be understood from the above, other than to connect or disconnect hydraulic lines used in powering the hydraulic cylinders previously mentioned, an operator need not leave the operator's seat of the tractor when attachment or detachment of the loader assembly 20 is undertaken. Accordingly, when compared with past loader designs having the requirement(s) that an operator would need to leave the operator's seat to manually operate a latching mechanism used in maintaining attachment of the loader assembly with the frame, the ease with which the instant arrangement accomplishes association with the frame may be quickly understood by one of ordinary skill in the art. Therefore, as will also be understood from the explanation just provided, maintenance and other tasks involving either the tractor, or the loader assembly 20 itself, may be easily undertaken without having to spend an extraordinary amount of time just on the attachment or detachment of the loader assembly 20.

It should be further noted that, upon complete removal of the loader assembly 20, the mast 24 is located far enough above the ground that sufficient clearance is provided to avoid contact with the front tires (not shown) of the tractor as it is moved away from the loader assembly 20.

It is to be understood that attachment of the loader assembly 20 to the tractor frame 22 simply involves a reversal of the steps just described. For instance, in attaching the mast 24 to the rear portion 42 of the frame 22, the boom cylinder 64 would be retracted (so as to move from its position, as shown in FIG. 4, to its position as shown in FIG. 1). At the same time as this rear attachment of the catch portion 48 to the rear 42 of the frame 22 takes place, retraction of the boom cylinder 64 enables the foot-like member 66 of the brace 28 to be moved upwardly away from the ground, and thereafter into substantially fitting engagement with the front portion 40 of the tractor frame 22.

Figure 7:
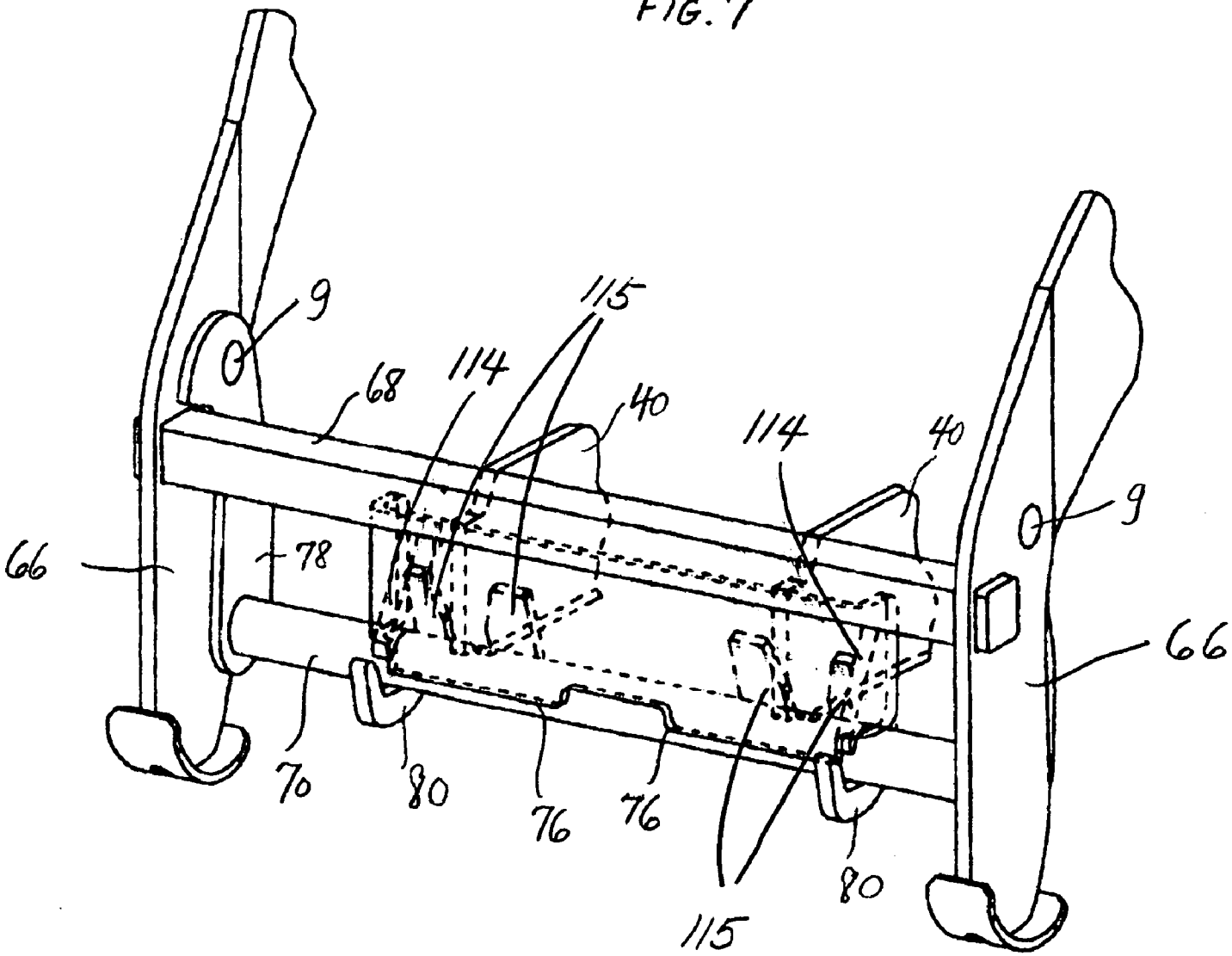
FIG. 7 is a side and perspective view of the attachment of the loader assembly to a front portion of the frame of the tractor.

In regard to the fitting engagement just mentioned, and when looking for example to FIGS. 3 and 7, it is to be understood that when the foot-like member 66 approaches contact with the front portion 40 of the frame 22, the upper contact member 68 becomes drawn back into its seating with the shelf-like segment 72. As the upper contact member 68 continues to become more fully seated therein, the hanger 78 pivots about point "g" as guides 114 carried thereon maneuver the lower contact member 70 into its seating with shelf-like segment 74. As this seating becomes more fully established, the ears 80 are able to grab against the tabs 76 to more securely position the foot-like member against the front portion 40 of the frame 22. Secondary guides 115, as shown in FIG. 7, are mounted on a backside of the lower contact member 70 and act to correctly center the lower contact member 70 relative to the ends of front frame portion 40.

Thus, a description of an arrangement for the attachment or detachment of an assembly to a base structure has been provided. As discussed above, this arrangement enables, upon the positioning of its various parts, substantially automatic attachment, or detachment, of a loader assembly relative to multiple portions of the tractor frame. In enabling that attachment, the arrangement uses a minimal number of parts that, when compared to past designs of arrangements intended for a similar purpose, enhances an operator's ability to easily and inexpensively control the attachment and removal operations associated with the loader assembly.

Having provided the above description, it will become apparent that various modifications can be made without departing from the scope of that description as further defined in the accompanying claims.

We claim:

1. A mounting arrangement comprising:

a) a tractor;

b) an assembly comprising:

1) a mast adapted to be received by the tractor, and which is moveable toward or away from the tractor;

2) a boom pivotally connected with the mast, the boom adapted to receive an implement;

3) a brace having a first end and a second end connected to the tractor, and 4) a camming mechanism between the mast and the first end of the brace, the second end of the brace substantially automatically detachable from the tractor upon rotation of the camming mechanism and movement of the brace into a substantially non-horizontal position, relative to the tractor, thereby allowing the brace to assist in stabilizing the assembly and the implement against the ground.

2. The assembly of claim 1 wherein:

the brace is oriented substantially horizontal relative to the tractor if the second end of the brace is attached to the tractor, and the brace is oriented substantially vertically relative to the tractor if the second end of the brace is detached from the tractor.

3. The assembly of claim 1 wherein:

the second end of the brace further comprises a ground engaging part for assisting in stabilizing the brace and the implement against the ground.

4. The assembly of claim 3 wherein:

the ground engaging part comprises automatically detachable contact members receivably associated with the tractor for assisting in detachment of the second end of the brace from the tractor during rotation of the camming mechanism and movement of the first end of the brace into a substantially non-horizontal position.

5. The assembly of claim 4 wherein:

the automatically detachable contact members comprise a pair of spaced apart contact members, each of which matingly engages the tractor.

6. An assembly for attaching an implement to a tractor, the assembly being operable in first and second modes and comprising:

a) a mast comprising a catch portion which assists in connecting it to the tractor, the mast being associated with the first mode in which it is attached to the tractor and the second mode in which it is detached from the tractor;

b) a brace extending substantially laterally from the mast and capable of obtaining first and second positions relative to the tractor; and c) a camming mechanism between the mast and brace, each of the mast and brace being responsive to rotation of the camming mechanism and movement of the brace to detach the assembly from the tractor upon disengagement of a latching structure.

7. The assembly of claim 6, wherein:

the camming mechanism comprises both a body and an extension, the extension being substantially housed within a portion of the body and which is selectively adjustable therefrom to enable its abutment with a portion of the mast.

8. A loader assembly for connection with a tractor frame, the assembly comprising:

a) a mast;

b) a boom;

c) at least one device capable of selective extension or retraction, the device being connected with the boom and the mast, the device enabling repositioning of a portion of at least one of the boom and the mast relative to the other thereof;

d) a brace operatively connected with the mast and the boom; and e) a camming mechanism connected to the brace, the camming mechanism comprising at least a body and an actuator, the actuator comprising a handle, the actuator being moveable between at least a first and a second position, such positions being respectively associated with the attachment and removal of the loader assembly relative to the frame, positioning of the actuator in its first position causing at least a portion of the body to be in substantial abutment with the mast, placement of the actuator in its second position causing at least a portion of the body to be moved away from the mast, movement of the actuator to its second position allowing substantially automatic detachment of the loader assembly from the frame upon extension of the at least one device.

9. A loader assembly for connection with a tractor frame, the assembly comprising:

a) a mast adapted to be supported on the frame at a first location;

b) a boom pivotally connected to the mast;

c) an extensible member operable to move the boom relative to the mast;

d) a brace pivotally coupled to the mast and adapted for coupling to the frame at a second location spaced from the first location; and e) a camming mechanism between the mast and brace and having a first position in which the brace and the mast are held relative to one another, wherein when the camming mechanism is in a second position, the brace uncouples from the frame and is movable to a ground engaging position such that the mast is substantially lifted from the frame and the loader is supported on the ground.

* * * * *